US008757993B2

(12) United States Patent
Sato

(10) Patent No.: US 8,757,993 B2
(45) Date of Patent: Jun. 24, 2014

(54) GEAR PUMP WITH FLUID COMMUNICATION PORTION

(75) Inventor: Tomo Sato, Kanagawa (JP)

(73) Assignee: TBK Co., Ltd., Tokyo (JP)

( * ) Notice: Subject to any disclaimer, the term of this patent is extended or adjusted under 35 U.S.C. 154(b) by 134 days.

(21) Appl. No.: 13/376,565

(22) PCT Filed: Jun. 25, 2009

(86) PCT No.: PCT/JP2009/061642

§ 371 (c)(1), (2), (4) Date: Dec. 6, 2011

(87) PCT Pub. No.: WO2010/150388

PCT Pub. Date: Dec. 29, 2010

(65) Prior Publication Data

US 2012/0082581 A1 Apr. 5, 2012

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl.

USPC ..... 418/206.4; 418/180; 418/189; 418/206.1

(58) Field of Classification Search

USPC ..... 418/180, 189–190, 206.1–206.9

See application file for complete search history.

(56) References Cited

U.S. PATENT DOCUMENTS

| | | | | |
|---|---|---|---|---|
| 1,644,401 | A * | 10/1927 | Ross | 418/206.4 |
| 2,531,726 | A * | 11/1950 | Durdin | 418/206.4 |
| 6,033,197 | A | 3/2000 | Brown et al. | |
| 6,527,530 | B2 * | 3/2003 | Boehland et al. | 418/180 |

FOREIGN PATENT DOCUMENTS

| | | | | |
|---|---|---|---|---|
| DE | 3414064 | A1 * | 10/1985 | 418/180 |
| GB | 2306354 | A | 5/1997 | |
| JP | 57-078792 | | 10/1980 | |
| JP | 08-093656 | | 4/1996 | |
| JP | 09-166092 | | 6/1997 | |
| JP | 2007-218128 | A | 8/2007 | |

OTHER PUBLICATIONS

International Search Report; PCT/JP2009/061642; Sep. 29, 2009.

* cited by examiner

*Primary Examiner* — Theresa Trieu

(74) *Attorney, Agent, or Firm* — Studebaker & Brackett PC

(57) ABSTRACT

In a gear pump according to the present invention, a wall surface portion of a casing (2) includes a drive side partition surface (41) on which tooth crests (11) of a drive gear (10) slide, a driven side partition surface (42) on which tooth crests (21) of a driven gear (20) slide, a suction side inner peripheral surface (43) that connects the drive side partition surface (41) and the driven side partition surface (42) on a suction chamber (3) side, and a discharge side inner peripheral surface (44) that connects the drive side partition surface (41) and the driven side partition surface (42) on a discharge chamber (4) side. Tapered portions (60) are provided in connecting portions between the respective partition surfaces (41, 42) and the discharge side inner peripheral surface (44) to cause tooth spaces (12, 22) surrounded by the wall surface portion of the casing (2) and teeth of the gears (10, 20) positioned near the partition surface (41, 42) side of the connecting portions to communicate gradually with the discharge chamber (4) as the gears (10, 20) rotate.

2 Claims, 7 Drawing Sheets

ANGLE $\theta$ = 0°

ANGLE $\theta$ =10°

ANGLE $\theta$ =20°

ANGLE $\theta$ =30°

ANGLE $\theta$ =40°

GEAR PUMP WITH FLUID COMMUNICATION PORTION

TECHNICAL FIELD

The present invention relates to a gear pump that pumps a fluid such as working oil in accordance with the rotation of a pair of gears that are externally meshed to each other.

TECHNICAL BACKGROUND

A gear pump includes a casing having a pump chamber formed in an interior thereof, a drive gear provided rotatably in the pump chamber, and a driven gear provided rotatably in the pump chamber and externally meshed to the drive gear so as to be driven to rotate thereby. A suction chamber that communicates with a suction port and a discharge chamber that communicates with a discharge port are formed in the pump chamber on either side of a meshing position between the drive gear and the driven gear (see Patent Document 1, for example). In this type of gear pump, fluid suctioned into the suction chamber is received in tooth grooves of the drive gear and the driven gear, transferred to the discharge chamber while tightly sealed between the tooth grooves and an inner peripheral wall surface of the pump chamber on which the gears slide, and then discharged from the discharge port.

PRIOR ARTS LIST

Patent Document

Patent Document 1: Japanese Laid-Open Patent Publication No. 2007-218128 (A)

SUMMARY OF THE INVENTION

Problems to be Solved by the Invention

In the conventional gear pump described above, however, at the same time as the fluid sealed into the tooth grooves of the drive gear and the driven gear is released into the discharge chamber as the gears rotate, an internal pressure of the discharge chamber (a discharge fluid pressure), which is set at a higher pressure than a discharge pressure in the suction chamber, is exerted on the fluid rapidly. As a result, rapid pressure variation occurs in the fluid sealed in the spaces between the tooth crests such that a load generated by the pressure variation acts on the respective gears, causing the gears to vibrate. Accordingly, noise is generated due to gear rattling.

The present invention has been designed in consideration of this problem, and an object thereof is to provide a gear pump configured to be capable of suppressing noise caused by gear rattling.

Means to Solve the Problems

To solve the problem described above, a gear pump according to the present invention is constituted by a first gear (a drive gear 10 according to an embodiment, for example) and a second gear (a driven gear 20 according to the embodiment, for example) provided to freely rotate about mutually parallel rotary shafts and meshed to each other, and a casing having a disposal space for holding the first gear and the second gear such that respective tooth crests and side faces thereof slide on a wall surface portion of the casing, with a suction chamber into which a fluid is suctioned and a discharge chamber from which the fluid is discharged as the first gear and the second gear rotate being formed in the casing, the wall surface portion of the casing includes a first partition surface (a drive side partition surface 41 according to the embodiment, for example) on which the tooth crests of the first gear slide, a second partition surface (a driven side partition surface 42 according to the embodiment, for example) on which the tooth crests of the second gear slide, a suction side inner peripheral surface that connects the first partition surface and the second partition surface on the suction chamber side, and a discharge side inner peripheral surface that connects the first partition surface and the second partition surface on the discharge chamber side, and fluid communication portions (tapered portions 60 according to the embodiment, for example) are provided in connecting portions between the respective partition surfaces and the discharge side inner peripheral surface to cause tooth spaces surrounded by the wall surface portion and teeth of the gears positioned near the partition surface side of the connecting portions to communicate gradually with the discharge chamber as the gears rotate.

In the gear pump constituted as described above, the casing preferably includes a first side face (a tip end surface 71 according to the embodiment, for example) on which one of the respective side faces of the first gear and the second gear slides, and a second side face (a sliding wall surface 53 according to the embodiment, for example) on which another of the respective side faces slides, and the fluid communication portions are preferably formed, in the connecting portions, from tapered surfaces (inclined surfaces 61 according to the embodiment, for example) that extend between the respective partition surfaces and the suction side inner peripheral surface and incline from the first side face side to the second side face side.

Advantageous Effects of the Invention

With the gear pump according to the present invention, the fluid communication portions are provided to cause the tooth spaces surrounded by the teeth of the gears and the wall surface portion to communicate gradually with the discharge chamber as the gears rotate, and therefore an internal oil pressure of the discharge chamber, which is set at a high pressure, can be caused to act on a fluid sealed into the tooth spaces gradually. As a result, the fluid in the tooth spaces can be prevented from undergoing rapid pressure variation, and therefore a load generated by such pressure variation can be prevented from acting on the gears. Accordingly, noise caused by gear vibration can be suppressed.

With the invention described above, a noise reduction effect can be achieved without a reduction in a pump discharge capability through a simple constitution by forming the fluid communication portions in the connecting portions from tapered surfaces that extend between the respective partition surfaces and the suction side inner peripheral surface and incline from the first side face side to the second side face side. Further, the fluid communication portion has a simple structure obtained simply by providing the tapered surface in the connecting portion, and therefore, when manufacturing the gear pump, the fluid communication portion can easily be formed integrally with the pump case through die casting, metal casting, resin molding, and so on simply by modifying or amending a part of a conventional molding die. Hence, a sophisticated oil pump in which noise is reduced can be manufactured while suppressing manufacturing costs.

DESCRIPTION OF THE EMBODIMENTS

Figure 1:
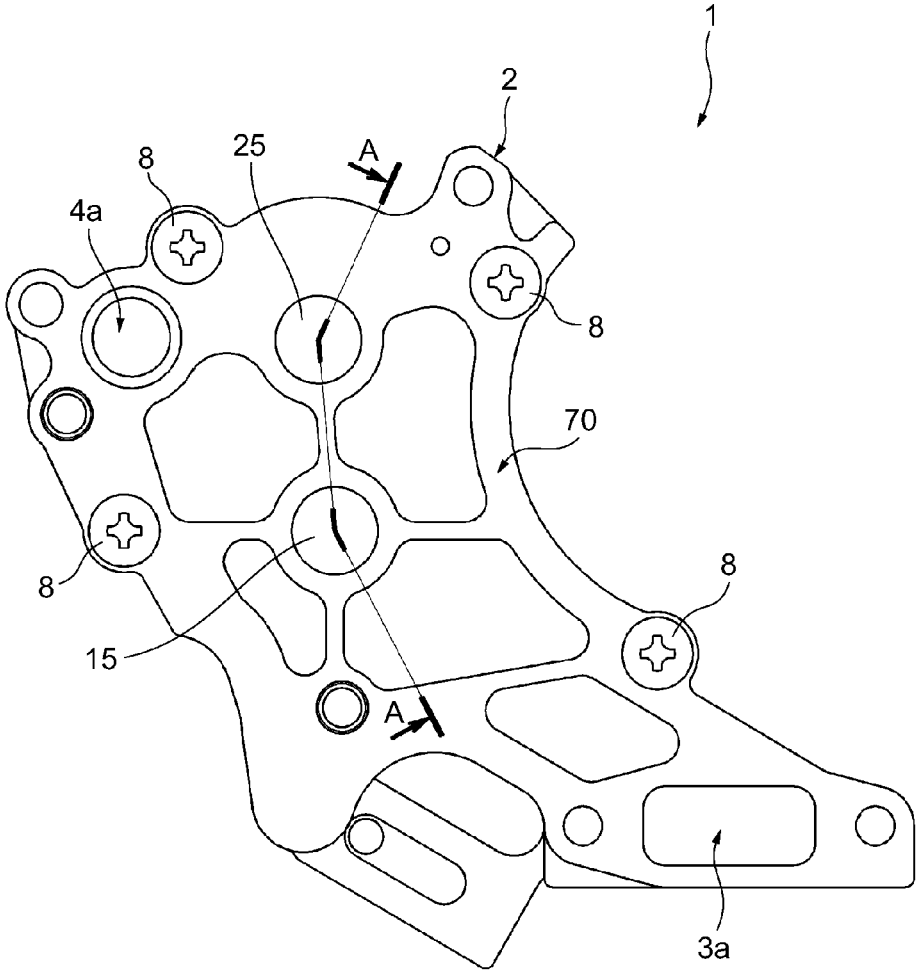
FIG. 1 is a front view showing a gear pump according to an embodiment of the present invention.
Figure 2:
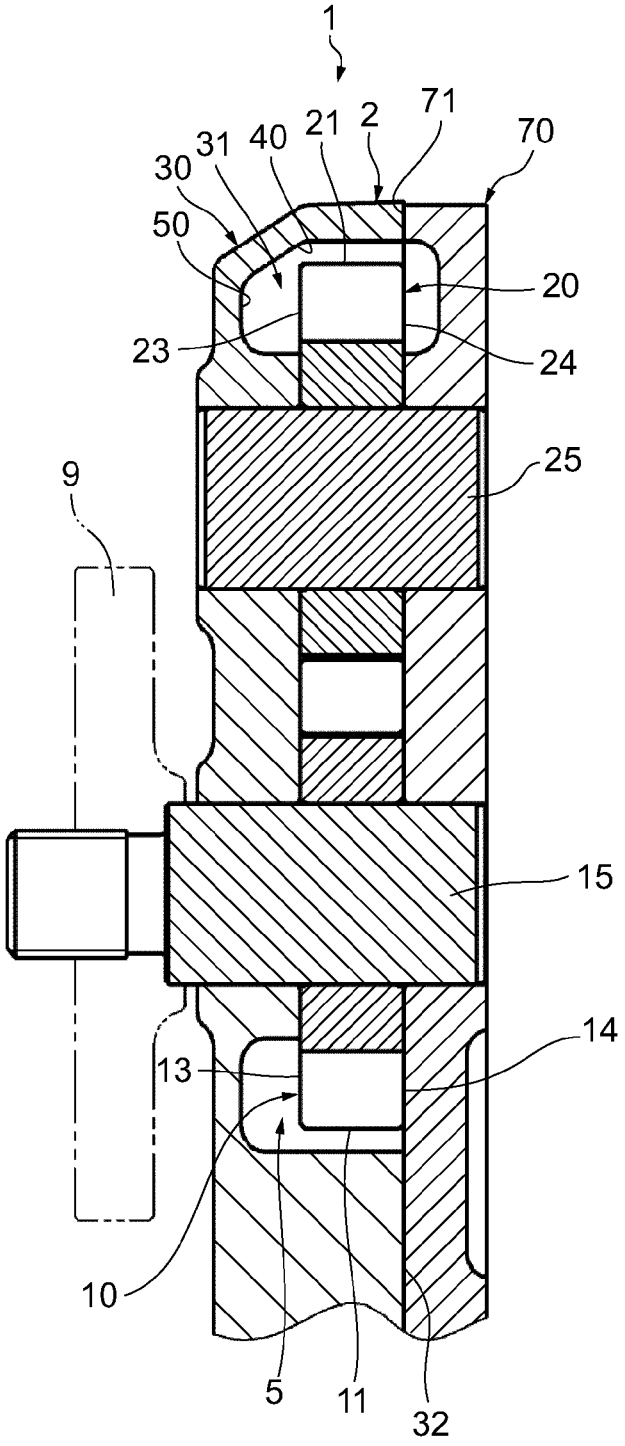
FIG. 2 is a side sectional view of the gear pump, taken along an arrow A-A in FIG. 1.
Figure 3:
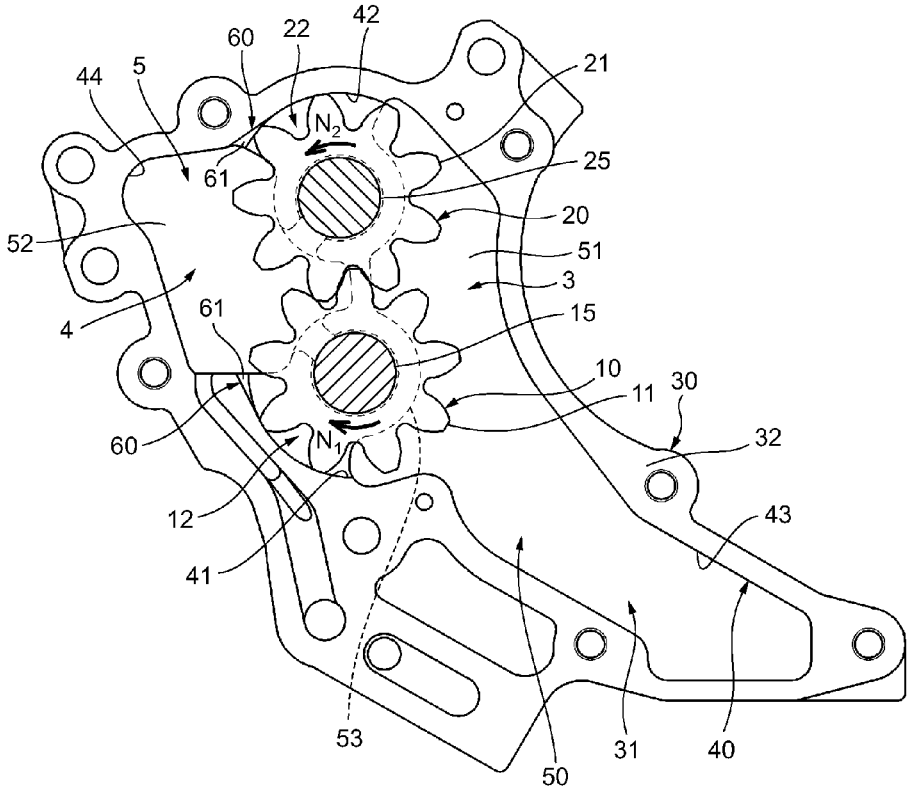
FIG. 3 is a front sectional view of the gear pump.
Figure 4:
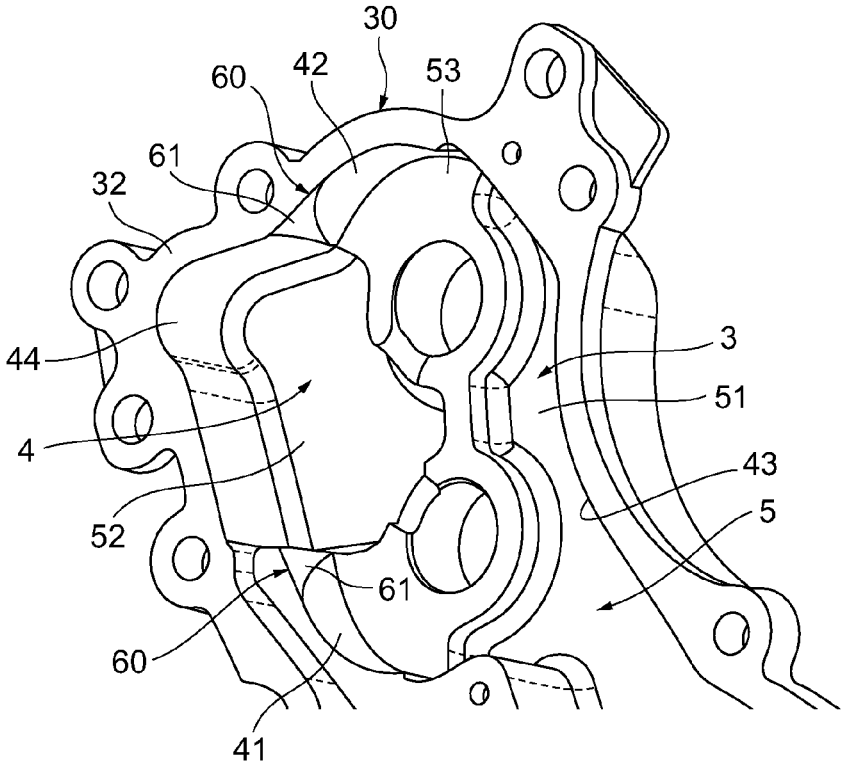
FIG. 4 is a perspective view of a pump case constituting a part of the gear pump.

A preferred embodiment of the present invention will be described below with reference to the drawings. FIGS. 1 to 4 show an oil pump serving as an example of a gear pump according to the present invention. An oil pump 1 is provided in a vehicle, not shown in the drawing, and uses an engine as a drive source to suction lubricating oil stored in a tank (an engine oil pan, for example) provided in the vehicle and discharge the suctioned lubricating oil into a lubricating oil passage connected to various parts of the engine. Here, FIG. 1 is a front view of the oil pump 1, FIG. 2 is a side sectional view of the oil pump 1, taken along an arrow A-A in FIG. 1, FIG. 3 is a front sectional view of the oil pump 1, and FIG. 4 is a perspective view showing a pump chamber of the oil pump 1.

The oil pump 1 is an externally meshed gear pump constituted by a drive gear 10 and a driven gear 20 that are provided to be free to rotate about mutually parallel rotary shafts and meshed to each other externally, and a casing 2 having a pump chamber 5 that houses and holds the drive gear 10 and the driven gear 20 such that tooth crests thereof slide on respective side faces of the pump chamber 5.

The drive gear 10 is coupled to and supported on a drive side rotary shaft 15 that is driven to rotate when a rotary driving force of an engine output shaft is transmitted thereto via a transmission gear 9. Thus, the drive gear 10 rotates integrally with the drive side rotary shaft 15 as the transmission gear 9 rotates. The driven gear 20, meanwhile, is coupled to and supported on a driven side rotary shaft 25 disposed to extend parallel to the drive side rotary shaft 15. Thus, the driven gear 20 is driven to rotate integrally with the driven side rotary shaft 25 in accordance with the rotation of the drive gear 10. The two rotary shafts 15, 25 are respectively supported on the casing 2 to be free to rotate via bearings, not shown in the drawings, disposed in the casing 2. Note that the two gears 10, 20 are involute spur gears having identical sectional shapes.

A main body of the casing 2 is constituted by a pump case 30 having a housing space 31 capable of housing and holding in its interior the two gears 10, 20 and so on, and a pump cover 70 that is attached to the pump case 30 by a screw fastening using a set bolt 8 so as to close the housing space 31. The pump chamber 5 is defined and formed in the interior of the casing 2 by covering a base end surface 32 of the pump case 30 with a tip end surface 71 of the pump cover 70. The drive gear 10 and the driven gear 20 are housed in the pump chamber 5 in a vertical arrangement and externally meshed to each other.

A suction chamber 3 and a discharge chamber 4 are formed as a continuation of the pump chamber 5 in the casing 2 on either side of the gears 10, 20, and a suction port 3*a* that communicates with the suction chamber 3 and a discharge port 4*a* that communicates with the discharge chamber 4 are formed in the pump cover 70. The suction chamber 3 communicates with the outside via the suction port 3*a*, which is connected to the tank, and the discharge chamber 4 communicates with the outside via the discharge port 4*a*, which is connected to the lubricating oil passage. Note that an internal oil pressure of the suction chamber 3 is set at a negative pressure in order to suction the oil, while an internal oil pressure of the discharge chamber 4 is set at a high pressure in order to discharge the oil.

The pump case 30 includes in its interior an inner peripheral wall surface 40 and a side wall surface 50 forming the housing space 31. The inner peripheral wall surface 40 is constituted by a drive side partition surface 41 that has an arc shape when seen from above and a substantially equal curvature to a tooth crest diameter of the drive gear 10 such that tooth crests 11 of the drive gear 10 slide thereon, a driven side partition surface 42 that has an arc shape when seen from above and a substantially equal curvature to a tooth crest diameter of the driven gear 20 such that tooth crests 21 of the driven gear 20 slide thereon, a suction side inner peripheral surface 43 that connects the drive side partition surface 41 and the driven side partition surface 42 on the suction chamber 3 side, and a discharge side inner peripheral surface 44 that connects the drive side partition surface 41 and the driven side partition surface 42 on the discharge chamber 4 side. The side wall surface 50, meanwhile, is constituted by a planar suction side wall surface 51 surrounded by the suction side inner peripheral surface 43, a planar discharge side wall surface 52 surrounded by the discharge side inner peripheral surface 44, and a sliding wall surface 53 that extends between the suction side inner peripheral surface 43 and the discharge side inner peripheral surface 44 and projects toward the housing space 31 side such that one side face 13, 23 of the two gears 10, 20 slides thereon.

The pump cover 70 slides on another side face (a side face on an opposite side to the side face 13, 23) 14, 24 of the two gears 10, 20 in a condition where the tip end surface 71 thereof covers the base end surface 32 of the pump case 30. By sandwiching the drive gear 10 and the driven gear 20 between the sliding wall surface 53 of the pump case 30 and the tip end surface 71 of the pump cover 70 in this manner, the drive gear 10 and driven gear 20 are housed and held in the pump chamber 5 such that movement thereof in an axial direction is restricted, and seals are formed on the side faces of the two gears 10, 20.

Drive gear 10 side tooth spaces 12 filled with oil to be pumped are formed in the pump chamber 5 so as to be surrounded by teeth of the drive gear 10, the drive side partition surface 41 and sliding wall surface 53 of the pump case 30, and the tip end surface 71 of the pump cover 70. Similarly, driven gear 20 side tooth spaces 22 are formed so as to be surrounded by teeth of the driven gear 20, the driven side partition surface 42 and sliding wall surface 53 of the pump case 30, and the tip end surface 71 of the pump cover 70.

When the two gears 10, 20 are rotated in the oil pump 1 configured as described above, the oil suctioned into the suction chamber 3 from the tank flows into the tooth grooves of the two gears 10, 20 so as to be sealed into the tooth spaces 12, 22, and in this condition, the oil is transferred into the discharge chamber 4 by a rotary motion of the gears 10, 20. The oil is then discharged into the lubricating oil passage through the oil port 4*a*.

At this time, the oil in the tooth spaces 12, 22 is transferred into the discharge chamber 4 from the suction chamber 3 while sealed between the teeth of the respective gears 10, 20, as described above, but at the same time as the sealed oil reaches the discharge chamber 4 so as to be released between the partition surfaces 41, 42 and the sliding wall surface 53, the internal oil pressure of the discharge chamber 4, which is set at a higher pressure than the internal oil pressure of the suction chamber 3, is exerted on the oil rapidly. As a result, rapid pressure variation occurs in the oil in the tooth spaces 12, 22 such that a load generated by the pressure variation acts on the gears 10, 20, causing the gears 10, 20 to vibrate. Hence, noise is generated due to gear rattling.

Figure 5A:
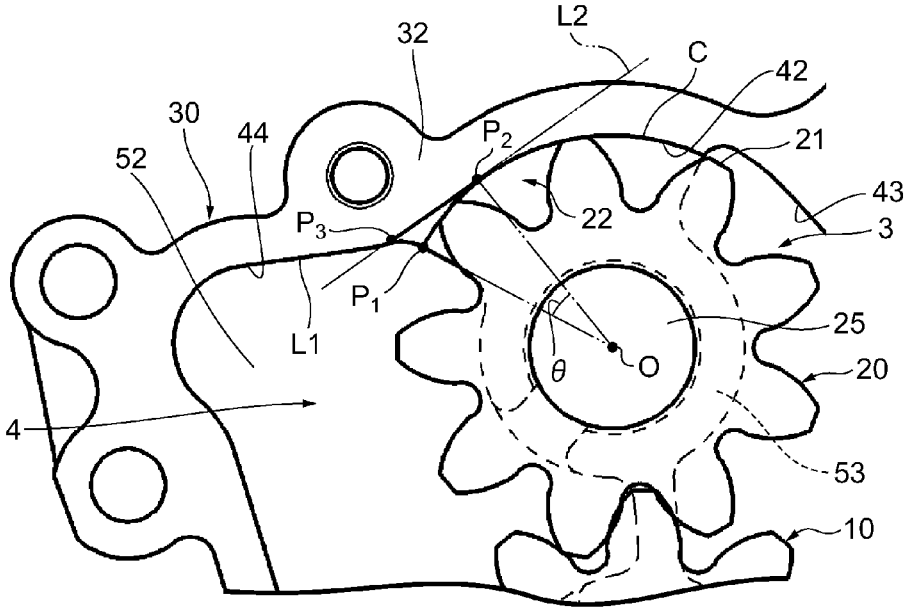
FIG. 5A and FIG. 5B are illustrative views illustrating shapes of a tapered portion.
Figure 5B:
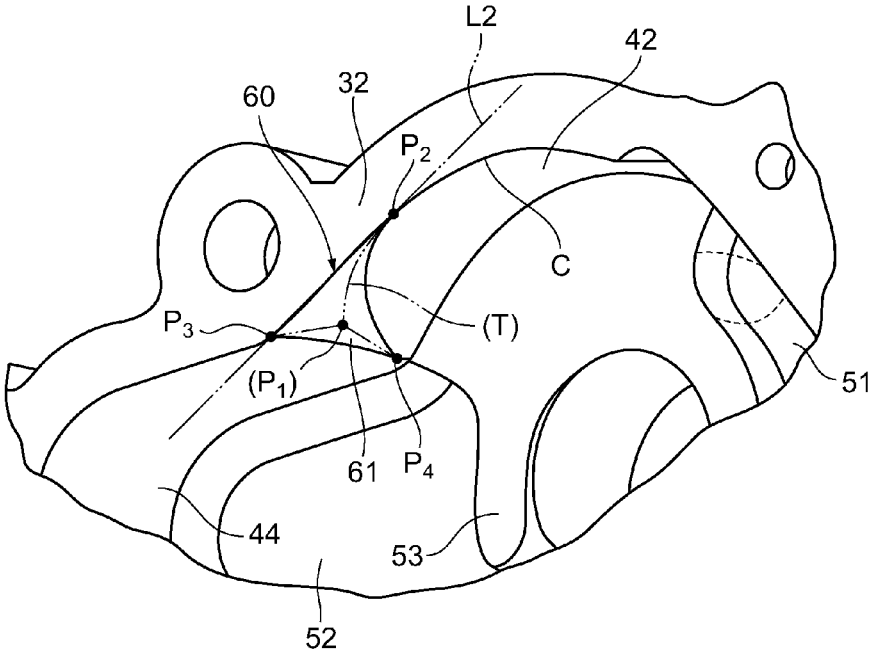
Figure 6A:
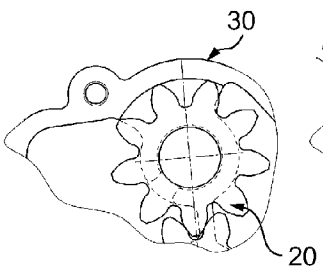
FIG. 6A to FIG. 6E are sectional views showing the main parts of the gear pump in relation to respective angles generated by varying an angle of the tapered portion.
Figure 6B:
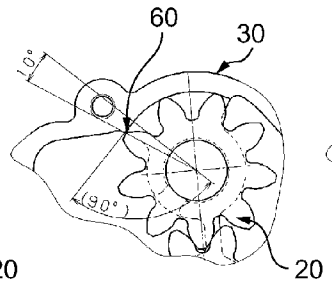
Figure 6C:
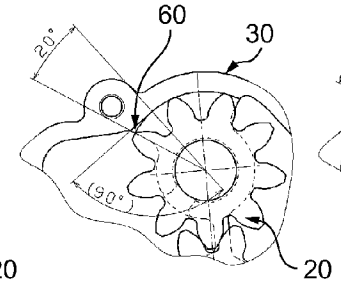
Figure 6D:
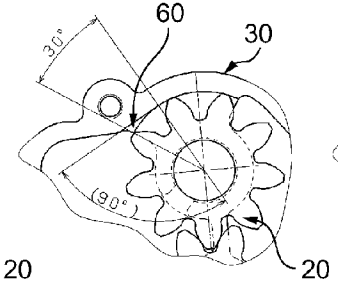
Figure 6E:
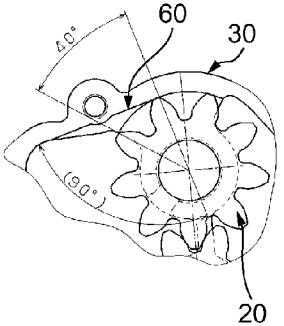

To deal with this problem, a tapered portion 60 formed in a chamfered shape is provided on the pump case 30 of the oil pump 1 as a structure for suppressing rapid pressure variation in the oil sealed in the tooth spaces 12, 22. The constitution of the tapered portion 60 will now be described with additional reference to FIG. 5. Here, FIG. 5 is an illustrative view illustrating the shape of the tapered portion 60. Note that the tapered portion 60 is provided respectively on the drive side partition surface 41 on which the tooth crests 11 of the drive gear 10 slide and the driven side partition surface 42 on which the tooth crests 21 of the driven gear 20 slide, but since the tapered portions 60 are constituted substantially identically, the constitution thereof on the driven gear 20 side will be described while omitting description of the constitution thereof on the drive gear 10 side.

The tapered portion 60 serving as a structure for suppressing pressure variation is provided within the pump case 30 in an intersecting part between the driven side partition surface 42 and the discharge side inner peripheral surface 44, and includes an inclined surface 61 that inclines within the pump case 30 from the base end surface 32 side toward the sliding wall surface 53 side.

When an intersection (an endpoint on an arc C) between the arc C defining the driven side partition surface 42 and a line L1 defining the discharge side inner peripheral surface 44 in the base end surface 32 of the pump case 30 is set as a point P1, a point obtained by moving in an inverse rotation direction of the driven gear 20 (a clockwise direction in FIG. 5A) along the arc C from the point P1 by an angle θ about a rotary axis O of the driven gear 20 is set as a point P2, an intersection between a tangent L2 of the point P2 on the arc C and the line L1 is set as a point P3, and a point where the driven side partition surface 42, the discharge side inner peripheral surface 44, and the sliding partition surface 53 intersect is set as a point P4, the inclined surface 61 of the tapered portion 60 is formed as a chamfered portion having a substantially triangular shape, in which the points P2, P3, P4 serve as vertices when an internal vertex (a vertex of a substantially triangular pyramid) T of the pump case 30 is cut in planes passing through the points P2, P3, P4.

Therefore, when the driven gear 20 rotates while the tooth crests 21 thereof slide on the driven side partition surface 42 such that the tooth space 22 of the driven gear 20 reaches the tapered portion 60, a part of the tooth space 22 opened by the tapered portion 60 widens gradually in a tooth width direction as the driven gear 20 rotates, and as a result, an opening area of the tooth space 22 also increases gradually. Hence, when the oil sealed in the tooth space 22 is released into the discharge chamber 4, the oil pressure of the discharge chamber 4 is exerted gradually on the oil through the opening in the tooth space 22, which is widened gradually by the tapered portion 60 as the driven gear 20 rotates, and as a result, rapid pressure variation acting on the oil in the tooth space 22 can be reduced, enabling a reduction in noise (meshing noise) caused by gear vibration.

Although oil transfer on the driven gear 20 side was described above, a similar effect, i.e. a noise reduction effect, can be obtained by the tapered portion 60 on the drive gear 10 side.

Next, an operation of the oil pump 1 will be described. When the engine is started such that the rotary driving force of the engine output shaft is transmitted to the drive side rotary shaft 15, the drive gear 10 rotates in a direction indicated by an arrow $N_1$ in FIG. 3, whereby the driven gear 20 externally meshed to the drive gear 10 is driven to rotate together with the driven side rotary shaft 25 in a direction indicated by an arrow $N_2$ in FIG. 3. When the two gears 10, 20 rotate while meshed to each other, oil is suctioned into the suction chamber 3 from the tank through the suction port 3*a*, and the suctioned oil flows into the tooth grooves of the gears 10, 20 so as to be sealed in the tooth spaces 12, 22. In this condition, the oil is transferred to the discharge chamber 4 side by the rotation of the gears 10, 20.

At this time, when the tooth spaces 12, 22 reach the tapered portion 60 (a position of the point P2 in FIG. 5), the tooth spaces 12, 22 and the discharge chamber 4 start to communicate with each other via the tapered portion 60 such that the internal oil pressure of the discharge chamber 4 starts to act on the oil in the tooth spaces 12, 22. As the gears 10, 20 rotate further, the opening (opening area) of the tooth spaces 12, 22 formed by the tapered portion 60 increases gradually such that the oil pressure from the discharge chamber 4 acts on the oil in the tooth spaces 12, 22 in a steadily wider range. Thus, the oil in the tooth spaces 12, 22 receives the oil pressure of the discharge chamber 4 gradually over time so as to approach the pressure of the discharge chamber 4 steadily. Therefore, the oil in the tooth spaces 12, 22 does not undergo rapid pressure variation, and a load generated by such pressure variation is prevented from acting on the gears 10, 20. Having been boosted to an equal pressure to the pressure of the discharge chamber 4, the oil is discharged into the lubricating oil passage through the discharge port 4*a*.

Hence, according to the oil pump 1, rapid pressure variation acting on the oil that is transferred by the two gears 10, 20 in the tooth spaces 12, 22 can be reduced, and as a result, noise (meshing noise) caused by gear vibration can be suppressed.

Figure 7:
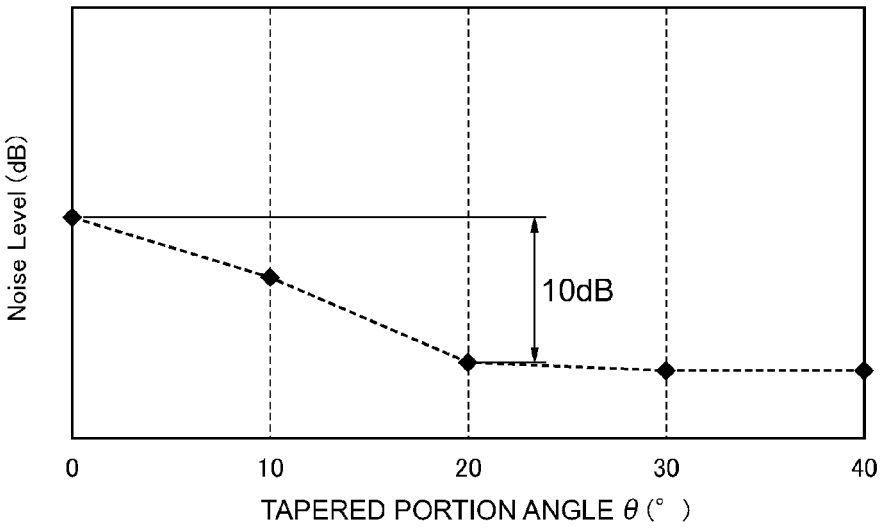
FIG. 7 is a graph showing a relationship between the angle of the tapered portion and a noise level.
Figure 8:
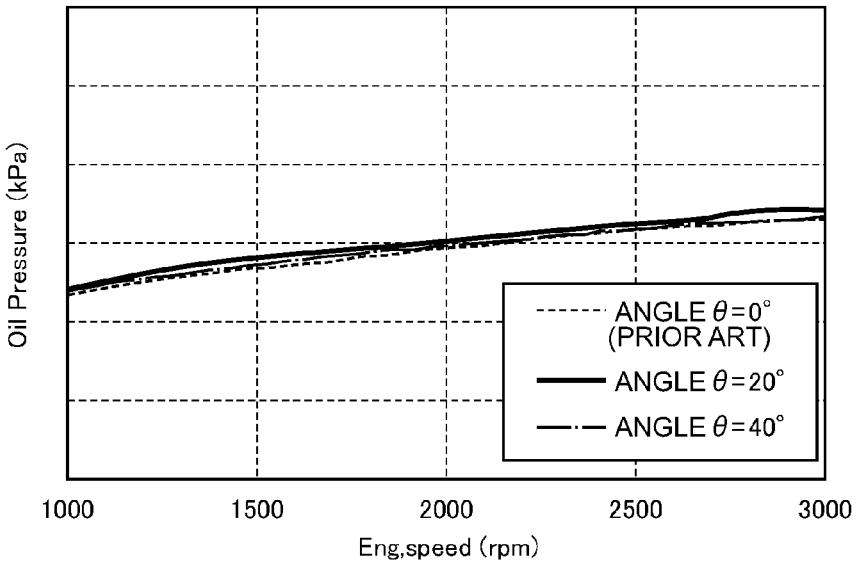
FIG. 8 is a graph showing a relationship between an engine rotation speed and a pump discharge pressure when the angle of the tapered portion is varied.

Next, the noise reduction effect and a pump discharge performance exhibited by the oil pump 1 configured as described above will be described with additional reference to FIGS. 6 to 8. Here, FIG. 6 is a sectional view showing the main parts of the gear pump in relation to respective angles generated by varying the angle θ of the tapered portion 60, FIG. 7 is a graph showing a relationship between the angle θ of the tapered portion 60 and a noise level, and FIG. 8 is a graph showing a relationship between an engine rotation speed and a pump discharge pressure when the angle θ of the tapered portion 60 is varied.

First, using FIG. 7, the noise reduction effect of the oil pump 1 will be described. In the oil pump 1 according to this embodiment, the noise level decreases as the angle θ increases such that when the angle θ is set at 20°, the noise level is reduced by approximately 10 dB in comparison with a conventional oil pump (in other words, an oil pump in which the angle θ=0). When the angle θ exceeds 20°, the noise level remains substantially constant. It is therefore evident that by providing the oil pump 1 with the tapered portion 60, a noise reduction effect is obtained. Note that in order to exhibit a noise reduction effect in the oil pump 1, the tapered portion 60 is preferably set such that the angle θ thereof equals or exceeds 20°.

Next, using FIG. 8, the pump discharge performance of the oil pump 1 will be described. It is known that in a conventional oil pump, the oil discharge pressure increases diagonally to the right substantially commensurately with an increase in the engine rotation speed. In the oil pump 1 according to this embodiment, a similar performance curve to that of a conventional gear pump is obtained, and therefore the discharge pressure does not decrease in comparison with that of a conventional oil pump.

It is therefore evident that even when the oil pump 1 is provided with the tapered portion 60 having a chamfered shape, an identical pump discharge performance to that of a conventional oil pump can be exhibited. Note that substantially no differences occur in the performance when the angle θ of the oil pump 1 is varied to 20° and 40°. Therefore, by setting the angle θ of the tapered portion 60 at 20° or more, a substantially equal noise reduction effect and pump discharge performance can be exhibited by the oil pump 1, regardless of the magnitude of the angle θ.

With the oil pump 1 according to this embodiment, described above, by providing the tapered portion 60 for causing the oil pressure from the discharge chamber 4 to act on the oil in the tooth spaces 12, 22 gradually as the gears 10, 20 rotate on the discharge side of the pump case 30, rapid pressure variation can be prevented from occurring in the oil in the tooth spaces 12, 22. Accordingly, a load generated by such pressure variation can be prevented from acting on the gears 10, 20, and as a result, noise (meshing noise) caused by gear vibration can be reduced. Further, with the oil pump 1, the pump discharge performance does not decrease in comparison with that of a conventional pump.

Furthermore, countermeasures such as increasing a gear processing precision have been taken conventionally to reduce noise generated by gear rattling, but such countermeasures lead to an increase in the manufacturing cost of the oil pump. According to the oil pump 1, on the other hand, the tapered portion can easily be formed integrally with the pump case through die casting, metal casting, resin molding, and so on simply by modifying or amending a part of a conventional molding die, and therefore a sophisticated oil pump in which noise is reduced can be manufactured while suppressing the manufacturing cost.

A preferred embodiment of the present invention was described above, but the scope of the present invention is not limited to the above embodiment. For example, the present invention is not limited to an externally meshed double gear pump, and may be applied to an externally meshed triple (tandem type) gear pump in which two driven gears are externally meshed to a drive gear. Further, the present invention is not limited to an oil pump that is provided in a vehicle to supply lubricating oil, and may be used in another device for another purpose, for example an oil pump that supplies working oil to a hydraulic actuator, or applied to another type of fluid pump such as an air pump or a water pump.

Explanation of Reference Numerals and Characters

1 oil pump (gear pump)
2 casing
3 suction chamber
4 discharge chamber
5 pump chamber
10 drive gear (first gear)
11 tooth crest
12 tooth space
20 driven gear (second gear)
21 tooth crest
22 tooth space
30 pump case
31 housing space (disposal space)
41 drive side partition surface (first partition surface)
42 driven side partition surface (second partition surface)
43 suction side inner peripheral surface
44 discharge side inner peripheral surface
53 sliding wall surface (second side face)
60 tapered portion (fluid communication portion)
61 inclined surface (tapered surface)
70 pump cover
71 tip end surface (first side face)

The invention claimed is:

1. A gear pump constituted by a first gear and a second gear provided to freely rotate about mutually parallel rotary shafts and meshed to each other, and a casing having a disposal space for holding said first gear and said second gear such that respective tooth crests and side faces thereof slide on a side wall surface of said casing, with a suction chamber into which a fluid is suctioned and a discharge chamber from which said fluid is discharged as said first gear and said second gear rotate being formed in said casing, said casing having a first side face on which one of said respective side faces of the first gear and the second gear slides and a sliding partition surface on which the other one of said respective side faces slides, the sliding partition surface is a part of the side wall surface and said side faces of the first gear and the second gear are in slidable contact with the sliding partition surface;

wherein said side wall surface of said casing has a first partition surface on which said tooth crests of said first gear slide, a second partition surface on which said tooth crests of said second gear slide, a suction side inner peripheral surface that connects said first partition surface and said second partition surface on a side of said suction chamber, and a discharge side inner peripheral surface that connects said first partition surface and said second partition surface on a side of said discharge chamber, and fluid communication portions are provided in connecting portions between said respective partition surfaces and said discharge side inner peripheral surface to cause tooth spaces surrounded by said side wall surface and teeth of said gears positioned near said partition surface of said connecting portions to communicate gradually with said discharge chamber as said gears rotate, each of said fluid communication portions having a tapered surface which extends between one of the respective partition surfaces and the discharge side inner peripheral surface and inclines from a side of the first side face to a side of the sliding partition surface of the casing.

2. The gear pump according to claim 1, wherein said tapered surface extends and inclines up to a point intersecting with said sliding partition surface of the casing.

* * * * *